US010911856B2

(12) United States Patent
Ng

(10) Patent No.: US 10,911,856 B2
(45) Date of Patent: Feb. 2, 2021

(54) EAR TIPS FOR EARPHONE

(71) Applicant: Casey Kong Ng, Oakland, CA (US)

(72) Inventor: Casey Kong Ng, Oakland, CA (US)

( * ) Notice: Subject to any disclaimer, the term of this patent is extended or adjusted under 35 U.S.C. 154(b) by 11 days.

(21) Appl. No.: 16/240,503

(22) Filed: Jan. 4, 2019

(65) Prior Publication Data

US 2019/0289380 A1 Sep. 19, 2019

Related U.S. Application Data

(60) Provisional application No. 62/613,436, filed on Jan. 4, 2018.

(51) Int. Cl.
*H04R 1/10* (2006.01)

(52) U.S. Cl.
CPC ..... *H04R 1/1016* (2013.01); *H04R 1/1058* (2013.01)

(58) Field of Classification Search
CPC .... H04R 25/65; H04R 25/652; H04R 25/654; H04R 25/656; H04R 2225/77; H04R 2460/11; A61B 7/02
See application file for complete search history.

(56) References Cited

U.S. PATENT DOCUMENTS 3,710,888 A * 1/1973 Peart ..... A61B 7/026 181/131
4,724,922 A * 2/1988 Kalayjian ..... G10K 11/22 181/130
4,880,076 A * 11/1989 Ahlberg ..... H04R 25/656 181/130
5,288,953 A * 2/1994 Peart ..... H04R 1/1016 181/130
5,449,865 A * 9/1995 Desnick ..... A61B 7/02 181/131

(Continued)

*Primary Examiner* — Fan S Tsang
*Assistant Examiner* — Ryan Robinson

(57) ABSTRACT

An ear tip connects to a nozzle of an earphone. The ear tip comprises a body having a lumen extending from a rearward opening to a forward opening, the rearward opening being sized and dimensioned to connect to the nozzle so that sound transmitted out of the nozzle passes through the lumen and is transmitted out the forward opening. The body comprises an inner core forming at least a portion of the lumen and an outer cover covering at least a portion of the inner core, wherein the inner core is made of material sufficiently rigid to avoid deformation when the ear tip is inserted into the ear canal of a user and the outer cover is made of a material less rigid than the material of the inner core and capable of being compressed and deformed by the ear canal when inserted thereinto. In one version, the inner core and the outer cover are arranged so that when the ear tip is inserted into an ear canal and the outer cover is deformed by the ear canal, the forward opening has an area equal to or greater than the area of the rearward opening. In another version, the inner core has a forward end opening larger than a rearward end opening of the inner core. In another version, the outer cover comprises a rearward segment, a forward segment sized or shaped differently than the rearward segment, and a connecting portion connecting the rearward segment and the forward segment and which allows the rearward segment and the forward segment to flex relative to one another.

20 Claims, 7 Drawing Sheets

(56) References Cited

U.S. PATENT DOCUMENTS 5,488,205 A * 1/1996 Major ..... H04R 25/652 181/129
6,310,961 B1 * 10/2001 Oliveira ..... H04R 25/656 381/328
6,671,381 B1 * 12/2003 Lux-Wellenhof ..... H04R 25/70 381/325
7,600,604 B2 * 10/2009 Babcock ..... A61F 11/08 128/864
7,627,131 B2 * 12/2009 Nielsen ..... H04R 25/652 181/135
7,837,005 B2 * 11/2010 Killion ..... A61F 11/08 181/129
8,160,288 B2 * 4/2012 Axelsson ..... H04R 1/1016 128/864
8,189,846 B2 * 5/2012 Tiscareno ..... H04R 1/1016 381/322
8,270,648 B2 * 9/2012 Murozaki ..... H04R 1/1091 381/312
8,385,577 B2 * 2/2013 Fickweiler ..... H04R 25/652 381/382
8,413,331 B2 * 4/2013 Tiemens ..... H04R 1/1016 29/896.21
8,498,440 B2 * 7/2013 Parkins ..... H04R 1/1016 381/328
8,573,353 B2 * 11/2013 Mulvey ..... A61F 11/08 181/130
8,761,424 B2 * 6/2014 Wubker ..... H04R 25/654 381/325
8,873,785 B2 * 10/2014 Wu ..... H04R 25/604 381/322
9,088,846 B2 * 7/2015 Blanchard ..... H04R 1/1016
9,167,336 B2 * 10/2015 Siahaan ..... B29C 43/021
9,197,956 B2 * 11/2015 Iseberg ..... H04R 1/1016
9,854,342 B2 * 12/2017 Basseas ..... H04R 1/1016
10,425,714 B2 * 9/2019 Lawand ..... H04R 1/1016
2003/0173144 A1 * 9/2003 Werblud ..... A61B 7/02 181/131
2013/0345170 A1 * 12/2013 Eddy ..... H04R 1/1008 514/63
2018/0160210 A1 * 6/2018 Begusch ..... H04R 1/1016
2019/0141430 A1 * 5/2019 Huwe ..... H04R 1/1058
2019/0208392 A1 * 7/2019 Merjanian ..... G01C 21/3632
2020/0077173 A1 * 3/2020 Wexler ..... H04R 1/1083

* cited by examiner

EAR TIPS FOR EARPHONE

PRIORITY

The present application claims the benefit of domestic priority based on U.S. Provisional Patent Application 62/613,436 filed on Jan. 4, 2018, the entirety of which is incorporated herein by reference.

BACKGROUND

With the proliferation of hand-held phones and music players, the transmission of sounds to the user has taken on important significance. While a smart phone may be able to store and play high quality recordings, if speakers are not able to deliver high quality sound to a user, then much of the technology within the phone is for naught. In similar manner, if a speaker system is not comfortable for a user to wear, no amount of high-fidelity sound is going to make for an optimally pleasurable experience.

Many miniaturized speaker systems have been developed. One system includes two earphones where each earphone includes a body housing a transducer that converts an audio signal into sound. The sound is transmitted from the body to a nozzle that is at least partially inserted into an ear canal of a user. To make the nozzle more comfortable and to more securely hold the nozzle within the canal, each nozzle may be equipped with an ear tip. The ear tip is typically made from a compressible material so that the ear tip can be lodged within the ear canal.

However, the conventional nozzle and ear tip systems suffer from several disadvantages. For example, conventional ear tips do not allow for optimal sound transmission. Furthermore, the compression of the ear tip by the walls of the ear canal can cause obstruction of the ear tip opening and thus distortion of the sound emanating therefrom. In addition, conventional ear tips do not optimally conform to the shape of an ear canal and therefore do not form ideal seals within the ear canal.

There is therefore a need for improved ear tips that improve the sound quality and/or user's comfort. There is further a need for an ear tip that reduces compression-induced distortion of sound quality. There is still further a need for an ear tip that conforms to the ear canal and creates an improved seal therein.

SUMMARY

The present invention satisfies these needs. In one aspect of the invention, an ear tip provides improved quality of sound delivered to a user.

In another aspect of the invention, an ear tip provides improved comfort for a user and/or improved fit of the ear tip with an ear canal.

In another aspect of the invention, an ear tip is designed so that its opening is not obstructed when the ear tip is inserted into an ear canal.

In another aspect of the invention, an ear tip is contoured to conform to the ear canal in an improved manner.

In another aspect of the invention, an ear tip connects to a nozzle of an earphone. The ear tip comprises a body having a lumen extending from a rearward opening to a forward opening, the rearward opening being sized and dimensioned to connect to the nozzle so that sound transmitted out of the nozzle passes through the lumen and is transmitted out the forward opening, wherein the body comprises an inner core forming at least a portion of the lumen and an outer cover covering at least a portion of the inner core, wherein the inner core is made of material sufficiently rigid to avoid deformation when the ear tip is inserted into the ear canal of a user and the outer cover is made of a material less rigid than the material of the inner core and capable of being compressed and deformed by the ear canal when inserted thereinto, and wherein the inner core and the outer cover are arranged so that when the ear tip is inserted into an ear canal and the outer cover is deformed by the ear canal, the forward opening has an area equal to or greater than the area of the rearward opening.

In another aspect of the invention, an ear tip connects to a nozzle of an earphone. The ear tip comprises a body having a lumen extending from a rearward opening to a forward opening, the rearward opening being sized and dimensioned to connect to the nozzle so that sound transmitted out of the nozzle passes through the lumen and is transmitted out the forward opening, wherein the body comprises an inner core forming at least a portion of the lumen and an outer cover covering at least a portion of the inner core, wherein the inner core is made of material sufficiently rigid to avoid deformation when the ear tip is inserted into the ear canal of a user and the outer cover is made of a material less rigid than the material of the inner core and capable of being compressed and deformed by the ear canal when inserted thereinto, and wherein the inner core has a forward end opening larger than a rearward end opening of the inner core.

In another aspect of the invention, an ear tip for connects to a nozzle of an earphone. The ear tip comprises a body having a lumen extending from a rearward opening to a forward opening, the rearward opening being sized and dimensioned to connect to the nozzle so that sound transmitted out of the nozzle passes through the lumen and is transmitted out the forward opening, wherein the body comprises an inner core forming at least a portion of the lumen and an outer cover covering at least a portion of the inner core, wherein the inner core is made of material sufficiently rigid to avoid deformation when the ear tip is inserted into the ear canal of a user and the outer cover is made of a material less rigid than the material of the inner core and capable of being compressed and deformed by the ear canal when inserted thereinto, and wherein the outer cover comprises a rearward segment, a forward segment sized or shaped differently than the rearward segment, and a connecting portion connecting the rearward segment and the forward segment and which allows the rearward segment and the forward segment to flex relative to one another.

DRAWINGS

These features, aspects, and advantages of the present invention will become better understood with regard to the following description, appended claims, and accompanying drawings which illustrate exemplary features of the invention. However, it is to be understood that each of the features can be used in the invention in general, not merely in the context of the particular drawings, and the invention includes any combination of these features, where:

DESCRIPTION

The present invention relates to ear tips. In particular, the invention relates to ear tips for use with earphones. Although the ear tip is illustrated and described in the context of being useful for earphones, the present invention can be useful in other instances. Accordingly, the present invention is not intended to be limited to the examples and embodiments described herein.

Figure 1:
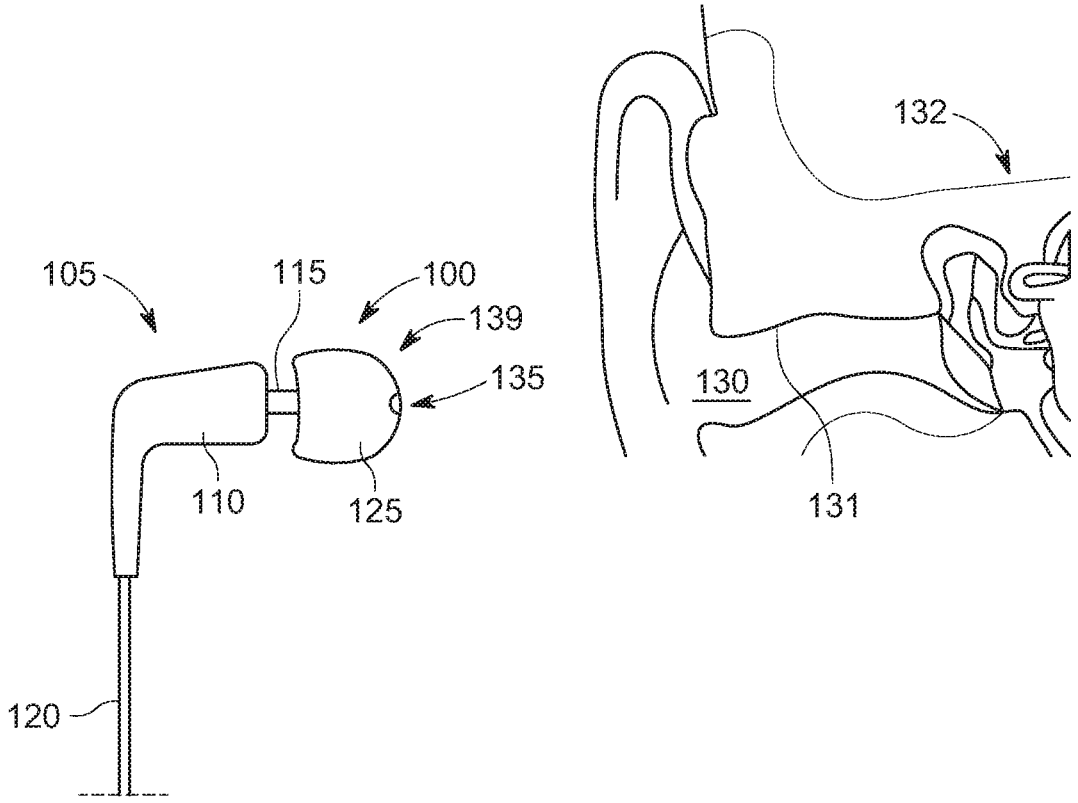
FIG. 1 is a schematic diagram of an ear tip according to the invention in use with an earphone.

FIG. 1 shows an ear tip 100 in accordance with one version of the invention installed on an earphone 105. The earphone 105 is made up of a body 110, a nozzle 115, and optionally a cable 120. The body 110 contains equipment that is capable of generating sound. For example, the body may house a driver that includes one or more various known transducers that receives an audio signal from the cable 120 and converts the audio signal into sound, as in known in the art. Alternatively, the driver may receive a wireless audio signal and convert the wireless audio signal into sound, as is known in the art. The driver directs the generated sound outwardly from the body and towards the nozzle 115. The nozzle 115 includes a hollow interior through which the sound travels. The nozzle 115 may be formed in one-piece with the body 110 or may be a separately attachable piece. In one version, the nozzle 115 and body 110 are a single piece that is injection molded. The nozzle 115 is generally rigid in that it resists deformation during normal earphone usage.

The ear tip 100 includes a hollow interior that receives the exterior portion of the nozzle 115, as will be described below, so that the ear tip 100 engages the nozzle 115 in a friction fit manner or can be connected in any other manner. The ear tip 100 has an exterior surface 125 sized and shaped so that when the ear tip 100 is installed on the nozzle 115, the ear tip 100 and nozzle 115 may be inserted into an ear canal 130 so that an exterior surface 125 of the ear tip 100 contacts the wall 131 of the ear canal 130. The ear tip 100 is compressible and is compressed by the wall 131 of the ear canal 130 so that it is held in place within the canal 130. The ear tip 100 further includes an ear tip forward opening 135 though which sound generated in the body 110 and delivered through the nozzle 115 may be delivered to the ear canal 130 and towards the inner ear 132 of a user. Advantageously and unlike with conventional ear tips, with the ear tip 100 of the present invention, the ear tip forward opening 135 does not become obstructed when the ear tips 100 are inserted into the ear canal 130 and securely held in place by the wall 131 of the ear canal 130. In another version, as will be described, the ear tip forward opening 135 is sized and shaped so as to provide improved sound transmission.

Figure 2A:
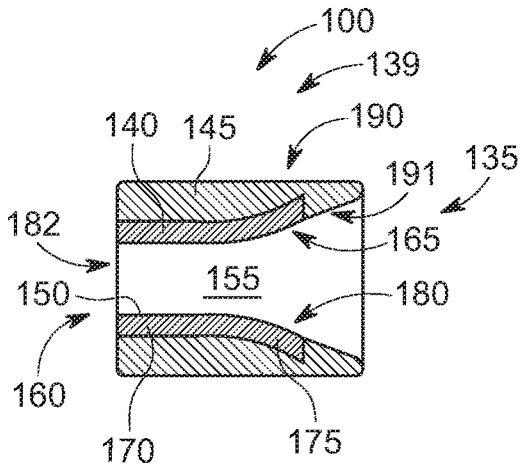
FIG. 2A is a schematic sectional view of a version of an ear tip according to the invention.

A version of an ear tip 100 according to the invention is shown in FIG. 2A. The ear tip 100 includes a body 139 comprising an inner core 140 and an outer cover 145 that at least partially surrounds the inner core 140. The inner core 140 may be of elastomeric or other material and is made of a material that is more rigid than the outer cover 145. The outer cover 145 may be made of a foam or rubber material or the like. In one particular version, the outer cover 145 comprises a memory foam material, such as polyurethane. The outer cover 145 is sized, shaped, and designed so that the outer cover 145 contacts and is compressed by the wall 131 of the ear canal 130 so that the ear tip 100 is secured within the ear canal 130. An interior wall 150 of the inner core 140 and/or the outer cover 145 defines a hollow lumen 155 of the ear tip 100 through which sound can travel. The lumen 155 extends from an ear tip rearward opening 160 to the ear tip forward opening 135 of the ear tip 100. In the version shown in FIG. 2A, the ear tip rearward opening 160 is defined by the rearward opening of the inner core 140. The rearward opening of the inner core 140 is connectable to the nozzle 115 of an earphone 105 in such a manner that the interior of the nozzle is in communication with the hollow lumen 155 of the ear tip 100. In one version, the ear tip rearward opening 160 may receive the nozzle 115 in a friction fit engagement. Thus, sound generated in the body 110 of the earphone is transmitted through the nozzle 115 to the hollow lumen 155 of the ear tip 100 and is then directed through the ear tip forward opening 135.

One of the advantages of the ear tip 100 of the present invention is that the ear tip forward opening 135 does not become obstructed when the ear tip is inserted into the ear canal. An obstructed opening is one in which the outer layer 145 becomes deformed during operation and covers a portion of the ear tip forward opening 135 in such a manner that the ear tip forward opening 135 is of smaller area and/or cross-sectional dimension than the opening of the nozzle or the opening of the ear tip rearward opening 160 of the ear tip 100 into which the nozzle 115 is inserted. In conventional ear tip designs, the foam cover extends over the front end of the inner core, and as a result the compression of the ear canal 130 causes the foam to obstruct the opening of the ear tip 100. This obstruction creates a distortion in sound being transmitted from the nozzle 115. The transducer in the body 110 of the earphone 105 transmits sound by air pressure. When the air pressure encounters a reduction in the size of an opening, turbulence is created. The turbulence causes distortion. High frequencies are particularly attenuated, and the clarity of sound is reduced. In accordance with the present invention, however, this distortion in sound is eliminated by assuring that the ear tip forward opening 135 remains unobstructed.

FIG. 2A shows an ear tip 100 design with an unobstructed ear tip forward opening 135 at the forward or insertion end of the ear tip 100. In the version of FIG. 2A, the inner core 140 includes a flared forward end 165. The inner core 140 has a cylindrical section 170 and then it transitions into a conical section 175 that defines the flared forward end 165. The conical section 175 may be in the form or a straight cone or may be curved. The flared forward end 165 has a forward end inner core opening 180 that is larger than the inner core opening at the rearward end of the ear tip 100. As can be further seen in FIG. 2A, the outer cover 145 may include a front portion 190 that extends over the forward end inner core opening 180. By providing a front portion 190 of an outer cover, the ear tip 100 can be comfortably received with the ear canal 130. Unlike in conventional ear tips where a front portion 190 becomes deformed and obstructs the opening, with the ear tip 100 of FIG. 2A, the compression and deformation of the front portion 190 is sufficiently small that it does not obstruct the ear tip forward opening 135. The size of the ear tip forward opening 135 when the front portion 190 is compressed remains as large as or larger than the size of the opening of the nozzle and/or the size of the opening of the lumen 155 of the inner core 140 at the ear tip rearward opening 160.

The prevention of the obstruction of the ear tip forward opening 135 can be accomplished in one or more ways. For example, as shown in FIG. 2A, flared forward end 165 of the inner core 140 can be make the forward end inner core opening 180 sufficiently large that even if it is partially covered by a deformation of the front portion 190, the ear tip forward opening 135 would remain as large as or larger than the ear tip rearward opening 160. Alternatively or additionally, the front portion 190 can have a tapered inner surface 191. By tapering inner surface it is meant that an orthogonal cross sectional dimension of the interior of the front portion at the forward end of the ear tip 100 is larger than the same dimension at the forward end inner core opening 180 when the ear tip 100 is undeformed. In this version, if the front portion 190 becomes deformed when inserted into the ear canal, the deformation will not obstruct the ear tip forward opening 135, i.e. the opening will not be smaller than the ear tip rearward opening 160. In one version, the taper angle can be an angle of 10 degrees or more from an axis parallel to the central axis of the lumen 155. In another version, the taper angle is 25 degrees or more. In another version, the taper angle is about 30 degrees.

Figure 2B:
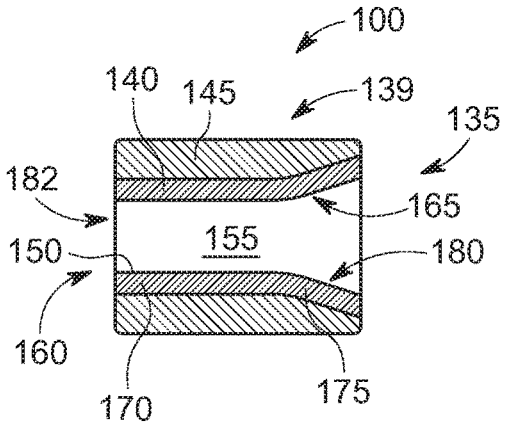
FIG. 2B is a schematic sectional view of another version of an ear tip according to the invention.
Figure 2C:
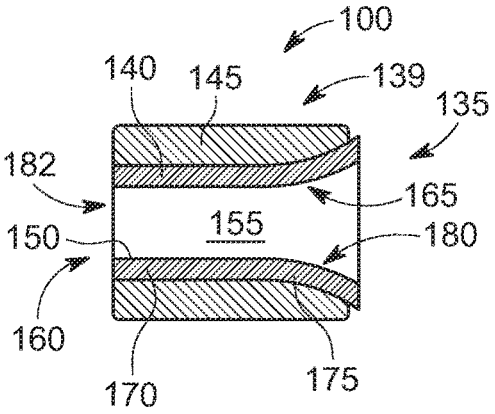
FIG. 2C is a schematic sectional view of another version of an ear tip according to the invention.
Figure 2D:
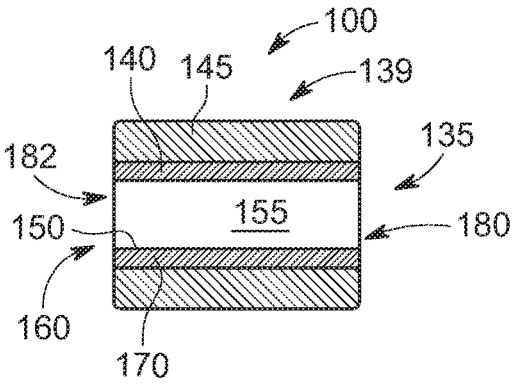
FIG. 2D is a schematic sectional view of another version of an ear tip according to the invention.
Figure 2E:
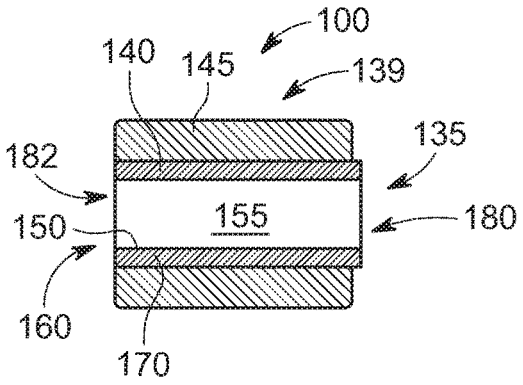
FIG. 2E is a schematic sectional view of another version of an ear tip according to the invention.

FIGS. 2B through 2E illustrate other versions of an ear tip 100 like the one shown in FIG. 2A where the ear tip 100 design prevents obstruction of the ear tip forward opening 135 when the ear tip is inserted into an ear canal 130. In the version of FIG. 2B, the inner core 140 extends the entire length of the ear tip 100. In this version, there is no front portion 190 of the outer cover 145 that can obstruct the ear tip forward opening 135. The version of FIG. 2C is similar to the one in FIG. 2B but with the inner core 140 extending beyond the outer cover 145 to even further assure there is no obstruction of the ear tip forward opening 135. The versions of 2D and 2E are similar to the versions of 2B and 2C, respectively, but with the flared inner core 140 replaced with an entirely conical inner core 140. In the versions of FIGS. 2D and 2E, the obstruction of the ear tip forward opening 135 is prevented by the elimination of the front portion 190 of the outer cover 145.

In one version of the invention, the forward end inner core opening 180 is larger than the rearward end inner core opening 182. The rearward end inner core opening 182 receives the earphone nozzle 115. Accordingly, the size of the rearward end inner core opening 182 corresponds generally with the size of the outlet of the nozzle 115. By making the size of the forward end inner core opening 180 larger than the rearward end inner core opening 182, sound transmission quality is improved. By having the forward end inner core opening 180 larger than the rearward end inner core opening 182, there is reduced air pressure and thus reduced acoustic impedance at the forward end inner core opening 180. The reproduction wave form that the speaker driver must push out is more drawn out by the reduction of air pressure at the forward end inner core opening 180.

Figure 3:
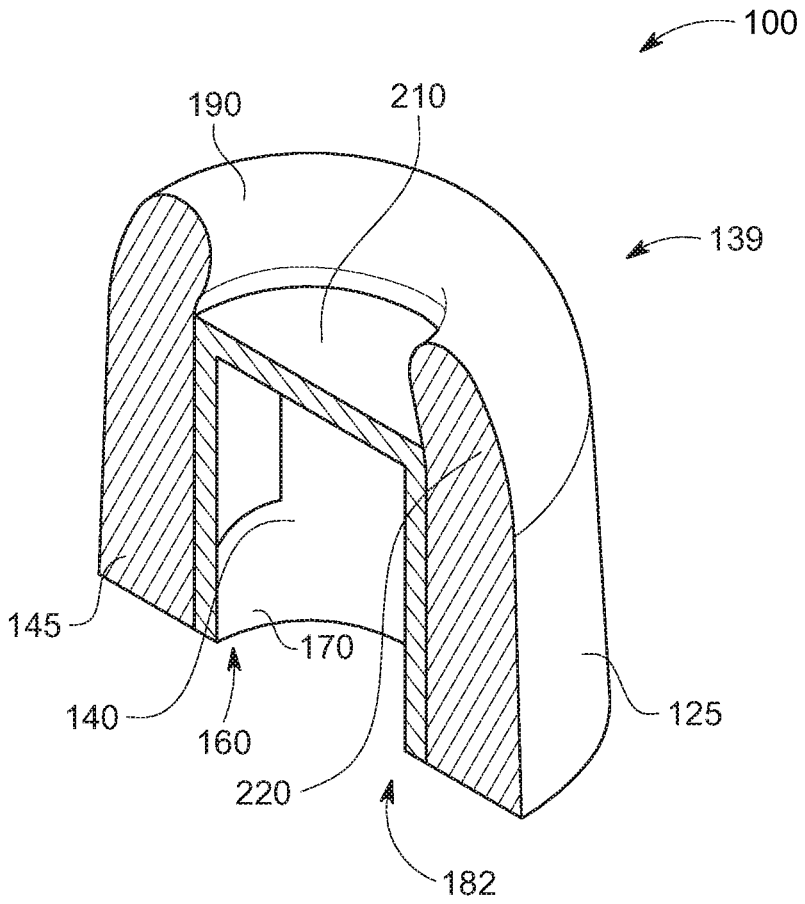
FIG. 3 is a schematic perspective view of another version of an ear tip according to the invention.

FIG. 3 shows a version of an ear tip 100 of the present invention equipped with a wax guard 210. The wax guard 210 may be composed of a highly permeable sheet of material, such as foam, fabric, paper, cloth, a mesh made from plastic or metal wires, or the like, and may be positioned at or near the forward end inner core opening 180. For example, the wax guard 210 may be positioned over the opening 180 or within the lumen 155 before the opening 180. The wax guard 210 may be positioned within a cylindrical section 170 of the inner core 140 or a conical section 175 of the inner core 140.

Also shown in FIG. 3 is more detail about the outer cover 145. The outer cover 145 includes an exterior 125 that is in contact with the wall 131 of the ear canal 130 when the ear tip 100 is inserted into the ear canal 130. The outer cover 145 can be composed, in whole or in part, of a compressible material, such as foam 220. In one particular version, the foam 220 comprises a memory foam material, such as polyurethane, viscoelastic polyurethane, and/or low-resilience polyurethane foam, latex, polyester, and the like. The foam 220 molds to the contours of the ear canal 130 and then recovers to its original shape when removed from the compressive environment. In the version shown in FIG. 3, the outer cover 145 is made up entirely of a single piece of foam 220. Alternatively, the outer cover 145 may be made up of multiple materials including the foam 220. For example, the foam 220 may be an exterior layer of the outer cover 145. In another example, the foam 220 may be an interior layer of the outer cover 145 and may be covered by another and different material, such as a different foam or rubber material or a coating of some form.

In one version, the outer cover 145 is made of two or more materials. An inner layer of foam 220 is coated with an outer layer of an antibacterial material. The ear tip 100 is the primary contact with the ear canal and is subject to contact with ear wax. The foam 220 is not easily cleaned. The foam can react to alcohol and thus need to be cleaned with water. However, following water cleaning, it can take a long time for the foam to sufficiently dry for optimum use. By applying an antibacterial coating to the foam 220, the ear tip 100 would not need to be cleaned as often. The coating can be applied by using a water-based spray at the time of manufacture; by using a nano-plasma activate agent that is dispersed to a finished ear tip 100 in a closed chamber; by using an antibacterial agent including a metallic ionic compound that is blended into the foam before polymerization; or the like.

Figure 4A:
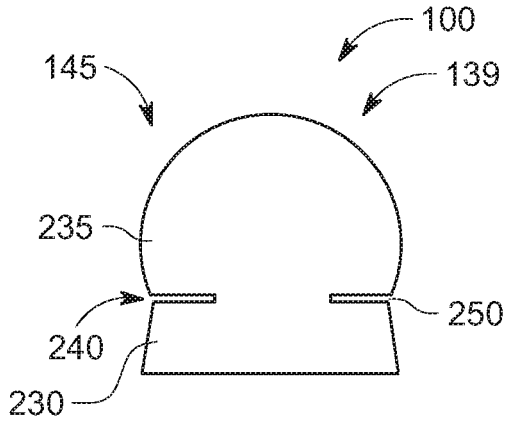
FIG. 4A is a schematic side view of another version of an ear tip according to the invention.
Figure 4B:
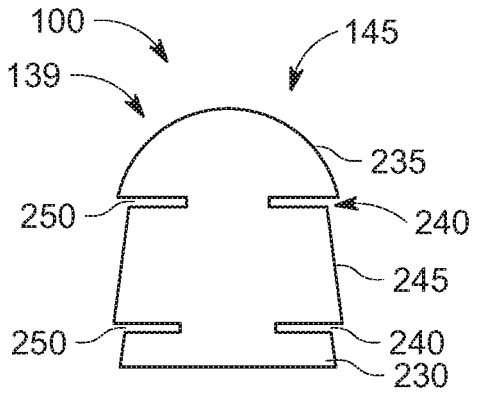
FIG. 4B is a schematic side view of another version of an ear tip according to the invention.

Another version of the outer cover 145 of an ear tip 100 according to the invention is shown in FIG. 4A. In the version of FIG. 4A, the ear tip 100 has an outer cover 145 made up of more than one segment, such as a rearward segment 230 and a forward segment segment 235. Between the rearward segment 230 and the forward segment 235 is a connecting portion 240. The connecting portion 240 allows the rearward segment 230 and the forward segment 235 to flex or bend with respect to one another. More specifically, as can be seen, each segment has a central axis extending in the insertion direction when the ear tip 100 is unflexed, and these axes can deflect relative to one another when inserted into the ear canal 130 by bending at the connecting portion 240. FIG. 4B shows a portion of another version of an ear tip with a rearward segment 230 and forward segment 235. In the version of FIG. 4B there is also one or more intermediate segments 245. The rearward segment 230 is connected to the intermediate segment 245 by a connecting portion 240, and the intermediate segment 245 is connected to the forward segment by another connection portion 240. Each of the segments can flex relative to one another.

Figure 4C:
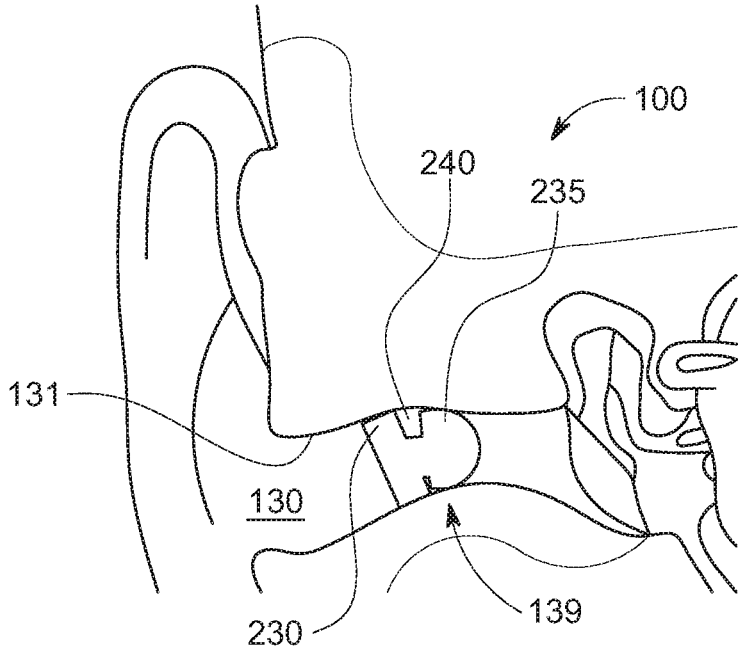
FIG. 4C is a schematic of the ear tip of FIG. 4A in use.
Figure 5A:
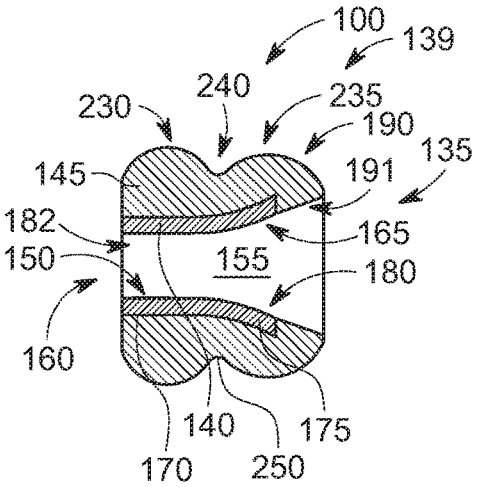
FIG. 5A is a schematic sectional view of a version of another version of an ear tip according to the invention.
Figure 5B:
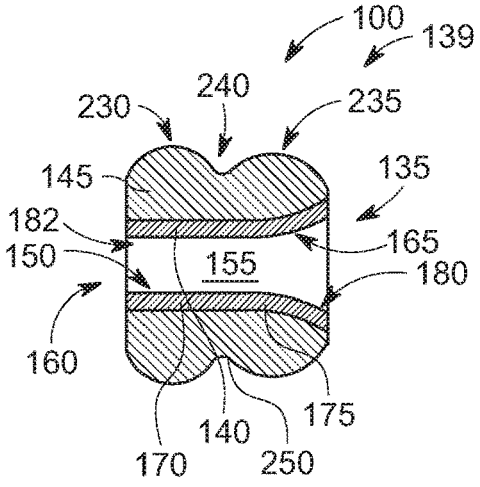
FIG. 5B is a schematic sectional view of another version of an ear tip according to the invention.
Figure 5C:
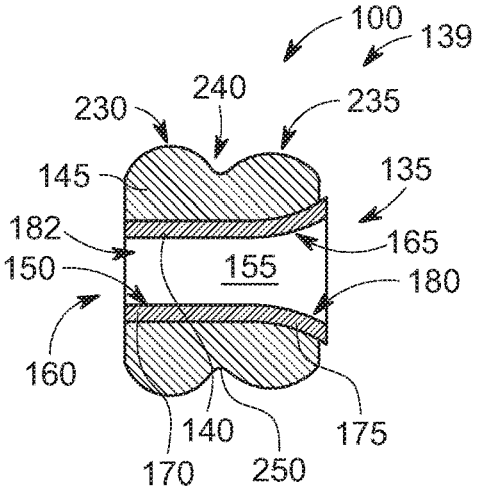
FIG. 5C is a schematic sectional view of another version of an ear tip according to the invention.
Figure 5D:
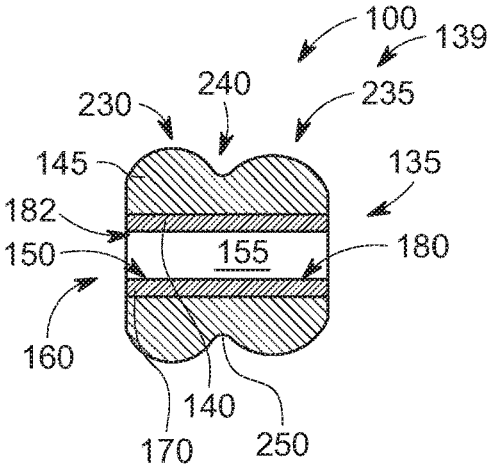
FIG. 5D is a schematic sectional view of another version of an ear tip according to the invention.
Figure 5E:
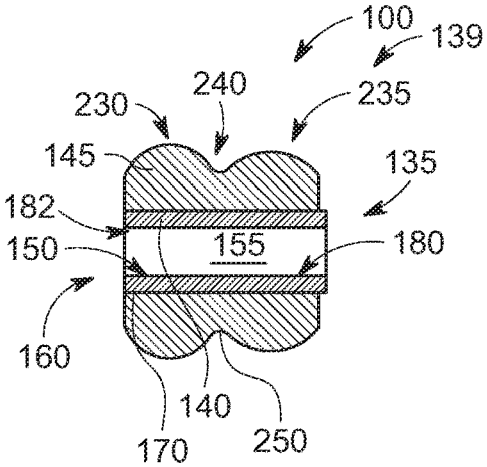
FIG. 5E is a schematic sectional view of another version of an ear tip according to the invention.

The segmented version of the ear tip 100, such as those shown in FIGS. 4A and 4B, allow for an improved fit of the ear tip 100 within an ear canal 130, as shown in FIG. 4C. The flexing of the forward segment 235 with respect to the rearward segment 230 allows the segments to conform to the ear canal 130 and provides an improved seal within the ear canal 130. An ear tip 100 that provides an improved seal is advantageous over those that provide less than a full seal. For example, the seal isolates environmental noise in an improved fashion. In addition, with the improved seal, there is less leakage that reduces the bass and audio quality. If there is a break in the seal, the bass will be the first sound quality that is disturbed. Also, outside ambient sound can be heard and can interfere with the music.

In one version, one or more of the segments 230, 235, 245 have a different outer contour shape than another of the segments. For example, in the version of FIG. 4A, the rearward segment 230 has an outer contour that is at least partially conical, and the forward segment 235 is at least partially spherical. In the version of FIG. 4B, the intermediate segment 245 also has an at least partially conical outer contour. In an alternative version, the outer contour of one or more of the segments 230, 235, 245 may be cylindrical, ovoid, paraboloid, and/or a polyhedron. The different outer contour of the segments may also be from the segments having the same type of contour shape but made of a different size, slope, or the like. Alternatively, all of the segments may be the same or similar.

FIGS. 5A through 5E show sectional views of an ear tip 100 having a segmented outer cover 145. The inner core 140 of each of FIGS. 5A through 5E are similar to the inner core 140 of FIGS. 2A through 2E, respectively. In this version, the rearward segment 230 and forward segment 235 both have a partially spherical outer contour but with differing radii of curvature. In the version shown, the radius of curvature of the rearward segment 230 is smaller than the radius of curvature of the forward segment 235. The connecting portion 240 has a reduced thickness portion 250 that allows the rearward segment 230 to flex relative to the forward segment 235.

Figure 6A:
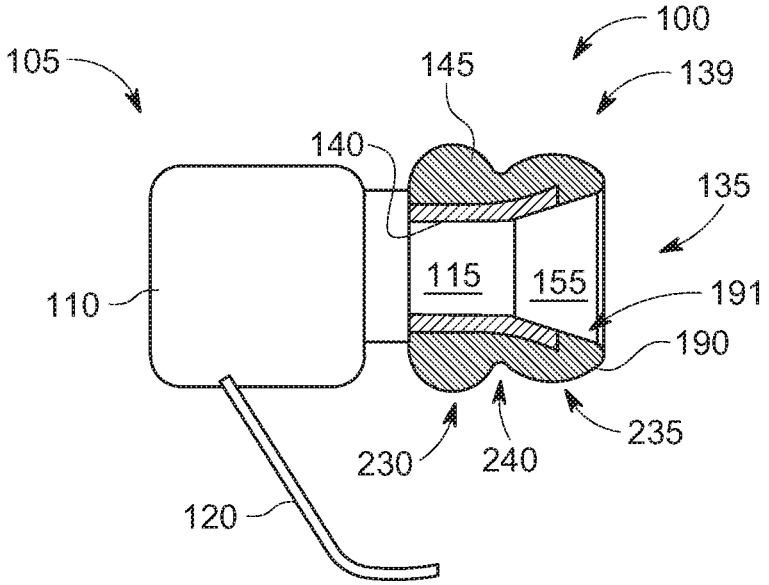
FIG. 6A is a schematic of the version of an ear tip according to the invention connected to a nozzle of an earphone.
Figure 6B:
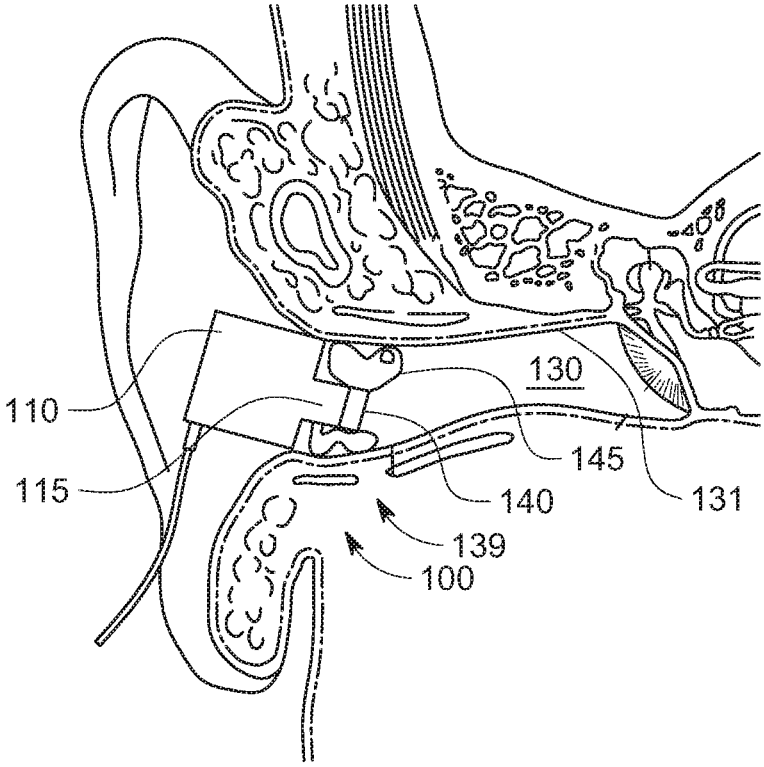
FIG. 6B is a schematic of the version of FIG. 7A in use and inserted into an ear canal.

FIG. 6A shows the ear tip 100 of installed on a conventional nozzle 115. FIG. 6B shows the ear tip 100 and nozzle 115 of FIG. 6A inserted into an ear canal 130. As can be seen in FIG. 6B, the forward segment 235 and the rearward segment 230 of the outer cover 145 can both compress and flex relative to one another. This dual action of compression and flexing allows the outer cover 145 to better conform to the shape of the ear canal 130. The inner core 140 remains undeformed when the outer cover 145 deforms. As can also be seen in FIG. 6B, the deformation of the outer cover 145 does not obstruct the ear tip forward opening 135.

Figure 7A:
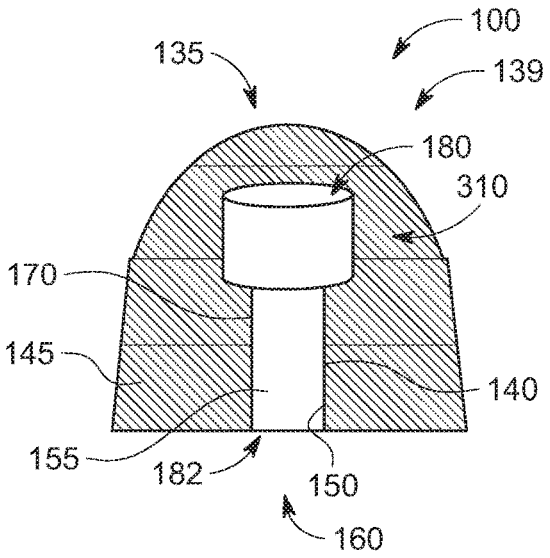
FIG. 7A is a partial schematic side view of a version of an ear tip according to the invention with a portion of the outer cover removed to show the shape of the inner core.
Figure 7B:
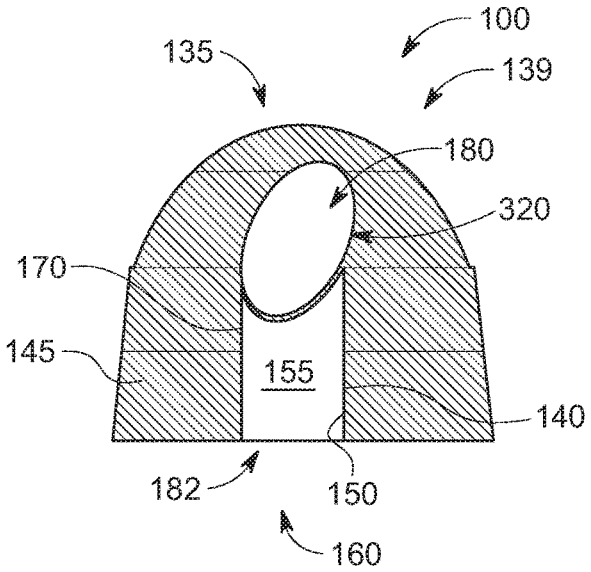
FIG. 7B is a partial schematic side view of another version of an ear tip according to the invention with a portion of the outer cover removed to show the shape of the inner core.
Figure 7C:
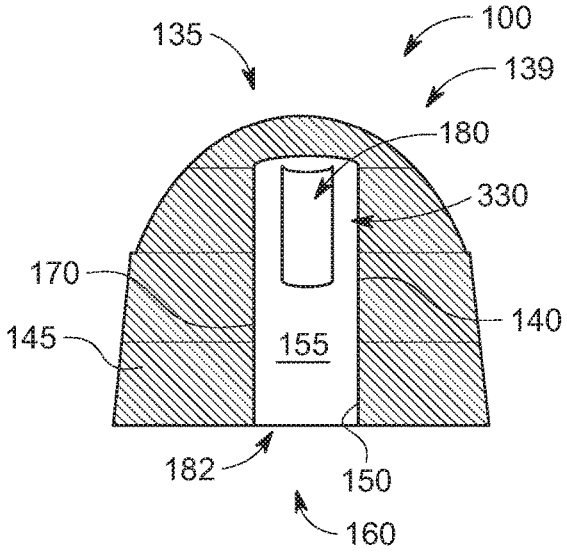
FIG. 7C is a partial schematic side view of another version of an ear tip according to the invention with a portion of the outer cover removed to show the shape of the inner core.
Figure 7D:
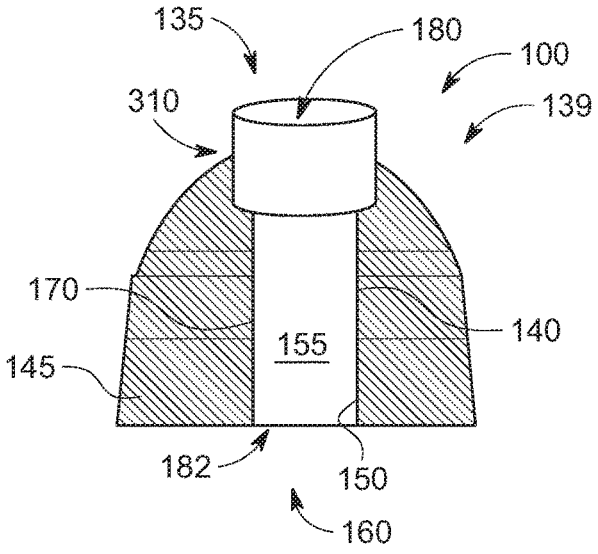
FIG. 7D is a partial schematic side view of another version of an ear tip according to the invention with a portion of the outer cover removed to show the shape of the inner core.

FIGS. 7A through 7D show alternative versions of inner core 140 designs. In all of these versions, the forward end inner core opening 180 is at least as large as or larger in area than the rearward end inner core opening 182. In each of FIGS. 7A through 7D a portion of the outer cover 145 has been removed to reveal the shape of the inner core 140. The version of FIG. 7A is similar to the flared opening discussed above but with the flare replaced by a cylindrical section 310 that is larger in diameter than the cylindrical section 170 at the forward end of the inner core 140. In the version of FIG. 7B, the forward inner core opening 180 is cut at an angle and is in an oval shape 320. The oval shape 320 creates a larger opening than the circular opening at the rearward inner core opening 182. In the version of FIG. 7C, the forward inner core pening 180 includes one or more side openings 330. The sum of the size of the end opening and the one or more side openings 330 adds to an area that is larger than the rearward inner core opening 182. The version of FIG. 7D is similar to the version of 7A but with the inner core 140 extending beyond the outer cover 145.

The ear tip 100 of the present invention may be manufactured using known techniques, such as extrusion and/or injection molding. With the versions where the core 140 is entirely cylindrical, the core 140 may be extruded, cut to a specific length, and then fit within the outer cover 145. For the version where the core 140 is not symmetrical, the core 140 can be made by injection molding and then can be individually embedded within the outer cover 145 during the polymerization of the foam 220.

Although the present invention has been described in considerable detail with regard to certain preferred versions thereof, other versions are possible, and alterations, permutations and equivalents of the version shown will become apparent to those skilled in the art upon a reading of the specification and study of the drawings. For example, the cooperating components may be reversed or provided in additional or fewer number. Also, the various features of the versions herein can be combined in various ways to provide additional versions of the present invention. Furthermore, certain terminology has been used for the purposes of descriptive clarity, and not to limit the present invention. Therefore, any appended claims should not be limited to the description of the preferred versions contained herein and should include all such alterations, permutations, and equivalents as fall within the true spirit and scope of the present invention.

What is claimed is:

1. An ear tip for connecting to a nozzle of an earphone, the ear tip comprising:

a body having a lumen extending from a rearward opening to a forward opening, the rearward opening being sized and dimensioned to connect to the nozzle so that sound transmitted from the nozzle passes through the lumen and is transmitted out the forward opening, wherein the body comprises an inner core forming at least a portion of the lumen and an outer cover covering at least a portion of the inner core, wherein the inner core has a rearward end opening and a forward end opening that is larger than the rearward end opening, wherein the inner core is made of material sufficiently rigid to avoid deformation when the ear tip is inserted into the ear canal of a user and the outer cover is made of a material less rigid than the material of the inner core and capable of being compressed and deformed by the ear canal when inserted thereinto, wherein the outer cover includes a front portion that extends forward of the forward end of the inner core, and wherein the inner core and the outer cover are arranged so that when the ear tip is inserted into an ear canal and the outer cover is deformed by the ear canal, the forward opening has an area equal to or greater than the area of the rearward opening in a manner that reduces the distortion of the sound coming from the nozzle.

2. An ear tip according to claim 1 wherein the inner core includes a cylindrical portion at the rearward end and a conical portion at the forward end.

3. An ear tip according to claim 1 wherein the outer cover forms at least a portion of the lumen.

4. An ear tip according to claim 3 wherein the portion of the outer cover that forms at least a portion of the lumen is tapered.

5. An ear tip according to claim 1 wherein the inner core forward end is flared.

6. An ear tip according to claim 1 wherein the outer cover comprises a rearward segment, a forward segment sized or shaped differently than the rearward segment, and a connecting portion connecting the rearward segment and the forward segment and which allows the rearward segment and the forward segment to flex relative to one another.

7. An ear tip according to claim 6 wherein the connecting portion comprises a reduced thickness portion have a thickness less than the rearward segment and the forward segment.

8. An ear tip according to claim 1 wherein the outer cover comprises polyurethane.

9. An ear tip according to claim 1 wherein the outer cover comprises a memory foam material.

10. An ear tip according to claim 1 wherein the outer cover is coated with an antibacterial material.

11. An ear tip according to claim 1 wherein the lumen includes a wax guard.

12. An ear tip for connecting to a nozzle of an earphone, the ear tip comprising:

a body having a lumen extending from a rearward opening to a forward opening, the rearward opening being sized and dimensioned to connect to the nozzle so that sound transmitted from the nozzle passes through the lumen and is transmitted out the forward opening, wherein the body comprises an inner core forming at least a portion of the lumen and an outer cover covering at least a portion of the inner core and also forming at least a portion of the lumen, wherein the inner core is made of material sufficiently rigid to avoid deformation when the ear tip is inserted into the ear canal of a user and the outer cover is made of a material less rigid than the material of the inner core and capable of being compressed and deformed by the ear canal when inserted thereinto, and wherein the inner core has a forward end opening that is larger than a rearward end opening of the inner core and wherein the inner core and the outer cover are configured in a manner that reduces the distortion of the sound coming from the nozzle.

13. An ear tip according to claim 12 wherein the inner core and the outer cover are arranged so that when the ear tip is inserted into an ear canal and the outer cover is deformed by the ear canal, the forward opening has an area equal to or greater than the area of the rearward opening.

14. An ear tip according to claim 12 wherein the outer cover includes a forward portion that extends forward of the forward end of the inner core.

15. An ear tip according to claim 12 wherein the outer cover comprises a rearward segment, a forward segment sized or shaped differently than the rearward segment, and a connecting portion connecting the rearward segment and the forward segment and which allows the rearward segment and the forward segment to flex relative to one another.

16. An ear tip according to claim 12 wherein the outer cover comprises a memory foam material.

17. An ear tip for connecting to a nozzle of an earphone, the ear tip comprising:

a body having a lumen extending from a rearward opening to a forward opening, the rearward opening being sized and dimensioned to connect to the nozzle so that sound transmitted from the nozzle passes through the lumen and is transmitted out the forward opening, wherein the body comprises an inner core forming at least a portion of the lumen and an outer cover covering at least a portion of the inner core, wherein the inner core is made of material sufficiently rigid to avoid deformation when the ear tip is inserted into the ear canal of a user and the outer cover is made of a material less rigid than the material of the inner core and capable of being compressed and deformed by the ear canal when inserted thereinto, and wherein the outer cover comprises a rearward segment, a forward segment sized or shaped differently than the rearward segment, and a connecting portion connecting the rearward segment and the forward segment and which allows the rearward segment and the forward segment to flex relative to one another, and wherein the forward segment includes a front portion that extends forward of the forward end of the inner core so that the front portion can be compressed to cover the forward end of the inner core in a manner where the forward opening reduces the distortion of the sound coming from the nozzle.

18. An ear tip according to claim 17 wherein the connecting portion comprises a reduced thickness portion have a thickness less than the rearward segment and the forward segment.

19. An ear tip according to claim 17 wherein the outer cover comprises polyurethane.

20. An ear tip according to claim 17 wherein the outer cover comprises a memory foam material.

* * * * *